US007118468B2

(12) United States Patent
Robichaud et al.

(10) Patent No.: US 7,118,468 B2
(45) Date of Patent: Oct. 10, 2006

(54) FLOOR SANDING VACUUM

(75) Inventors: Philip Robichaud, Wilbraham, MA (US); Mark Dunn, Wilmette, IL (US); William Meyer, III, Libertyville, IL (US)

(73) Assignee: William W. Meyer & Sons, Inc., Skokie, IL (US)

( * ) Notice: Subject to any disclaimer, the term of this patent is extended or adjusted under 35 U.S.C. 154(b) by 0 days.

(21) Appl. No.: 11/139,104

(22) Filed: May 27, 2005

(65) Prior Publication Data

US 2005/0266784 A1 Dec. 1, 2005

Related U.S. Application Data

(60) Provisional application No. 60/575,271, filed on May 28, 2004.

(51) Int. Cl.
*B24C 9/00* (2006.01)

(52) U.S. Cl. ..... 451/456; 451/40; 451/87; 451/442; 125/13.01

(58) Field of Classification Search ..... 451/456, 451/87, 92, 38, 40, 442; 125/13.01
See application file for complete search history.

(56) References Cited

U.S. PATENT DOCUMENTS

| | | | | |
|---|---|---|---|---|
| 4,509,963 | A * | 4/1985 | Jackson | 55/324 |
| 4,646,482 | A * | 3/1987 | Chitjian | 451/87 |
| 4,993,200 | A * | 2/1991 | Morioka et al. | 451/88 |
| 5,529,530 | A * | 6/1996 | McPhee et al. | 451/88 |
| 6,394,080 | B1 * | 5/2002 | Zavala | 125/13.01 |
| 6,823,907 | B1 * | 11/2004 | Cheng | 144/286.1 |
| 6,833,016 | B1 | 12/2004 | Witter | |

* cited by examiner

*Primary Examiner*—Lee D. Wilson
*Assistant Examiner*—Anthony Ojini
(74) *Attorney, Agent, or Firm*—David C. Brezina; Barnes & Thornburg, LLP

(57) ABSTRACT

A floor sanding vacuum is designed to be used in conjunction with floor sanding machines to provide a near dust free process for sanding floors. A displacement blower is driven by a gasoline or electric motor which creates a high vacuum that draws air through the sanding machine via a flexible hose connected to a cyclone separator where the sanding debris drops into an integral hopper. After the cyclone, the air is drawn through an air filter to the blower where the cleaned air is discharged through either an optional integral silencer built into the base of the vacuum or a commercially available silencer for noise reduction.

16 Claims, 3 Drawing Sheets

FLOOR SANDING VACUUM

This application claims priority to provisional application No. 60/575,271 filed May 28, 2004.

FIELD OF THE INVENTION

This invention relates to vacuums used with floor sanders for sanding floors of surfaces including, but not limited to, wood, concrete, stone, tile, and the like.

SUMMARY OF THE INVENTION

The floor sanding vacuum is designed to be used in conjunction with floor sanding machines when refinishing wooden floors, concrete floors, stone floors, tile floors and the like. The use of the vacuum provides a dust-free, or near dust free process, and eliminates airborne dust that can settle on and damage the newly finished surface. Use of a dust free system also eliminates dust being dispersed throughout the home, increases the speed and efficiency of the job, and reduces worker/consumer exposure to potentially harmful sanding byproducts.

The vacuum consists of a fabricated base that may also include an integral silencer. Mounted to the base of the unit is either a gas engine or high efficiency electric motor with an integral control keypad and digital readout, a cyclone separator, dust containment hopper, and a high efficiency and or a H.E.P.A filter.

The motor or engine is used to drive a positive displacement blower. The blower creates a high vacuum that draws air through the sanding machine via a flexible hose connected to a cyclone separator where the sanding debris drops into the integral hopper. After the cyclone, the air is drawn through a air filter and or a H.E.P.A. filter to the blower where the cleaned air is discharged through either an optional integral silencer built into the base of the vacuum or a commercially available silencer for noise reduction.

At least two models will be available; a gasoline model that will be installed in a truck, trailer, van or other vehicle; an electric motor driven unit that will be portable and mounted on wheels so it can be moved into a building, close to the work area. When used in a building, the electric model may be equipped with a High Efficiency Particulate Air Filter (H.E.P.A.) with a filtration efficiency of 99.97% for particles 0.3 microns or larger.

Additional features of the present disclosure will become apparent to those skilled in the art upon consideration of the following detailed description of illustrative embodiments of the disclosure.

DETAILED DESCRIPTION OF THE PREFERRED EMBODIMENT

Figure 1:
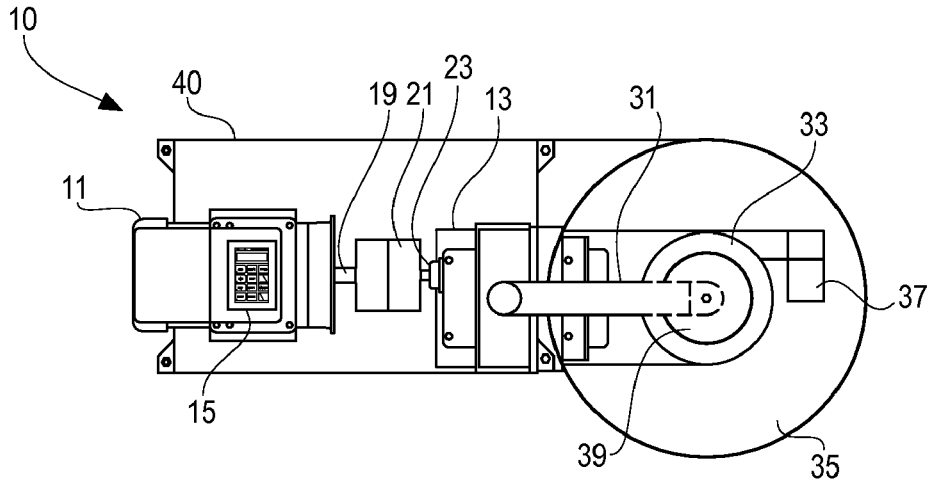
FIG. 1 is a top view of the floor sanding vacuum.
Figure 2:
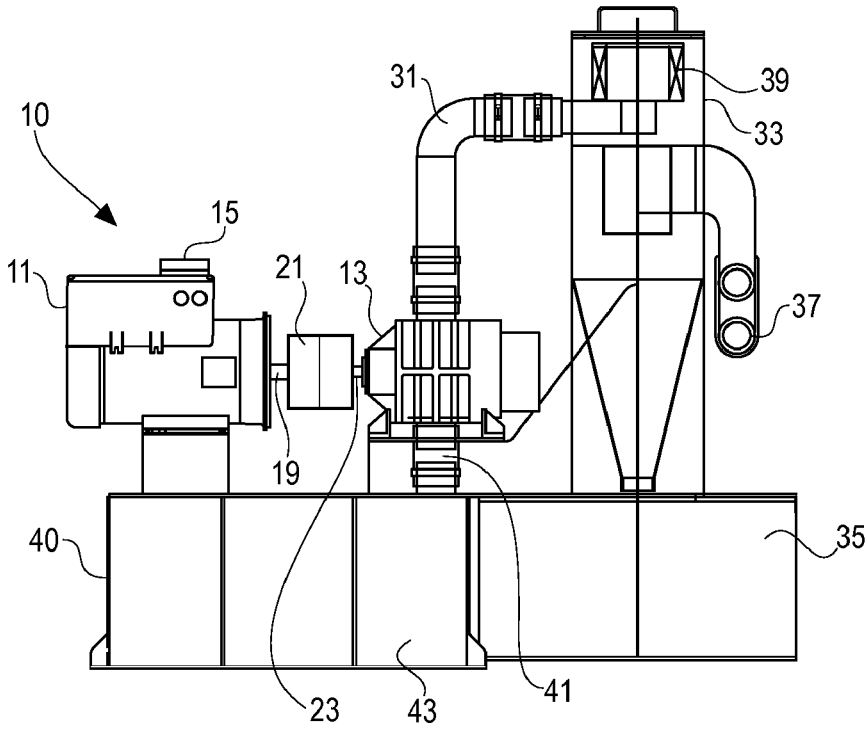
FIG. 2 is a side view of the floor sanding vacuum.
Figure 3:
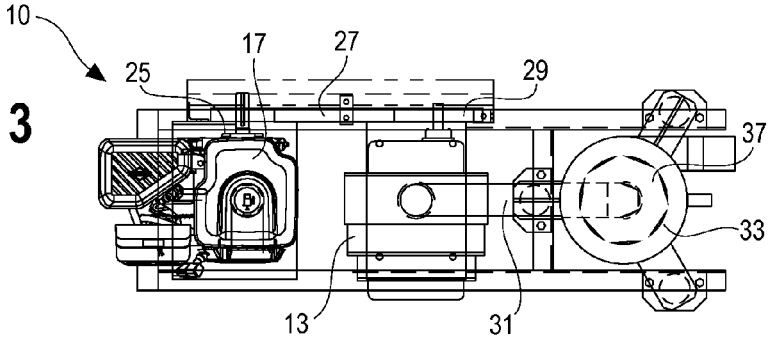
FIG. 3 is a top view of the floor sanding vacuum mounted on a base.
Figure 4:
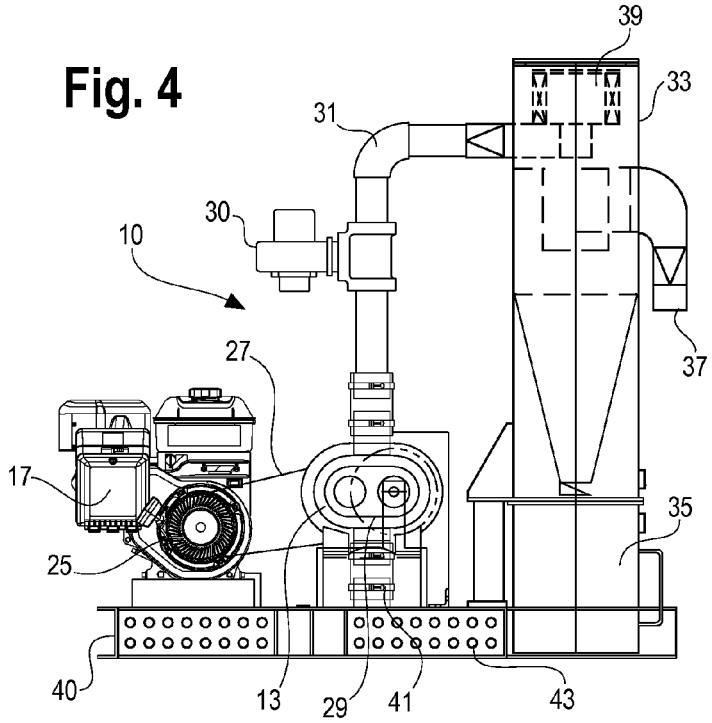
FIG. 4 is a side view of the floor sanding vacuum mounted on a base.

The floor sanding vacuum 10 includes a motor 11 coupled to a positive displacement blower 13. The motor 11 is preferably an electric motor with an integral electronic control pad 15, as shown in FIG. 1 and FIG. 2. One skilled in the art will recognize other types of motors can be used with this invention. For instance, as shown in FIGS. 3 and 4, a gasoline motor 17 can be used. The power of the gas engine may be of 12 HP and have a 12 V battery.

FIG. 1 and FIG. 2 show the electric motor 11 includes a first drive shaft 19 connected to a coupling 21. The coupling 21 is connected to a second drive shaft 23 of a displacement blower 13. With such an arrangement, the rotational force of the electric motor 13 is transferred to the positive displacement blower 13 allowing the blower to create a draw of air or a high vacuum. In an alternate embodiment, shown in FIGS. 3 and 4, the gasoline motor 17 includes a pulley 25 to which is connected a drive belt 27. The drive belt 27 is connected to a second pulley 29 attached to the displacement blower 13. One skilled in the art will recognize that other arrangements for transferring the power from the motor to the displacement blower 13 can be used. A gear box would be but one example.

The positive displacement blower 13 is connected by suitable duct work 31 to a cyclone separator 33. The cyclone separator includes a hopper 35 to collect the sanding debris. The duct work 31 may also include a vacuum relief valve 30.

The cyclone separator includes an input 37 to allow for connection to the sanding machine, not shown. The sanding machine, as one skilled in the art will recognize, generates sanding dust as it operates. The sanding machine will often have an output allowing a vacuum to be connected to the sanding machine in order to draw the sanding particles away from the sanding machine, so they are not distributed throughout the room. The connection between the input 37 and the sanding machine is preferably done with a flexible hose, as typically used in vacuum applications. The input 37 is generally suitable for a 2 inch hose, to connect to a sanding machine. When using more than one hose to connect a sanding machine to input 37, hose connectors will generally be used, or any other suitable means of connecting currently known in the art and hereafter developed.

Figure 5:
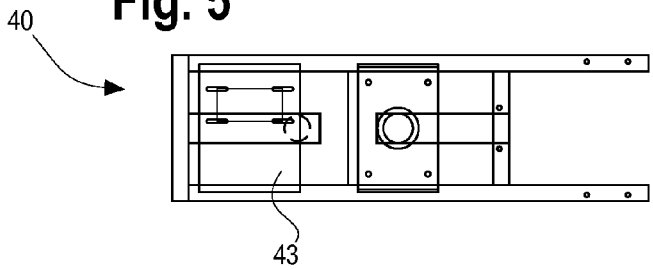
FIG. 5 is a top view of the base.
Figure 6:
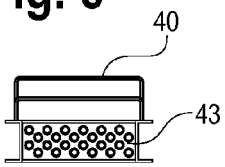
FIG. 6 is a side view of the base.
Figure 7:
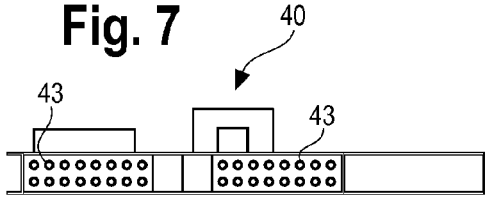
FIG. 7 is a side view of the base.

In operation, sanding particulates are drawn through the input 37 into the cyclone separator 33, where particulates fall out of the air and are collected in the integral hopper 35. The air is then drawn through a replaceable filter element 39. The replaceable filter element is preferably a HEPA filter, capable of removing 99.97% of particulates 0.3 microns or larger. The air is then drawn through the duct work 31 to the positive displacement blower 13, where it is expelled out in output 41. The air can also then be sent through an optional silencer 43, to reduce the noise associated with the operation. The silencer 43 may also filter the exhaust output of the gasoline motor 17. Both the integral hopper 35, and the silencer 43, may be part of the base 40, to which the motor, displacement blower 13, and the cyclone separator 33 are attached. FIG. 5, FIG. 6 and FIG. 7 an embodiment of the base (40) and the silencer 43 being attached. A collector bag (not shown), generally made of plastic or any suitable material known in the art, may be connected, by any means known in the art, to the vacuum 10 to collect the dust and debris from the output 41.

Figure 9:
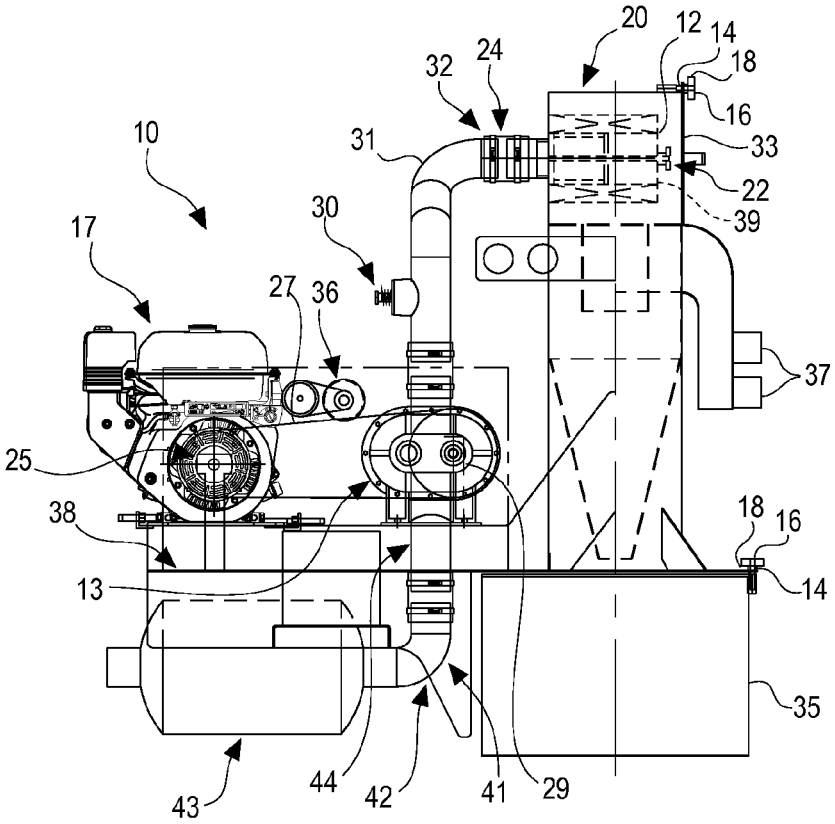
FIG. 9 is a side view of the floor sanding vacuum with a gasoline motor.

The filter element 39 requires regular cleaning, preferably at least once per day when in use. To clean the filter element 39, the housing 20, shown in FIG. 9, is opened with knob 16. Bolt 22 and filter retaining plate 12 are removed to allow access to filter element 39. The filter element 39 is pulled straight out to remove from housing. To clean the filter element 39, it is rapped to dislodge any loose dust and is reinserted into the housing. As recognized by those skilled in the art, a pressure gauge may be appropriately adapted to the present disclosure. If a pressure gauge reads 40" W.C. or pressure drop is excessive, the vacuum should be shutdown and filter cleaned as described herein.

Figure 8:
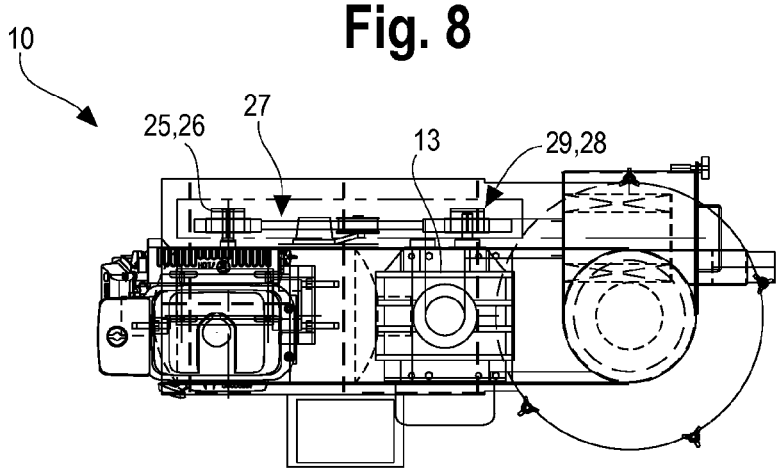
FIG. 8 is a top view of the floor sanding vacuum.

In another embodiment, shown in FIGS. 8 and 9, the floor sander vacuum 10 has the gasoline motor 17 and includes a pulley 25, which may also be a sheave, to which is connected a drive belt 27, which may also be a V-belt. The pulley 25, may have a first bushing 26. The drive belt 27 is connected to a second pulley 29, which may also have a second bushing 28, attached to the positive displacement blower 13. In addition, FIG. 9 shows a tensioner 36 to allow for appropriate tension in drive belt 27.

The positive displacement blower 13 is connected by suitable duct work 31 and a hose 24, secured by a clamp strap 32 to a cyclone separator 33. The cyclone separator includes a hopper 35 to collect the sanding debris. The duct work 31 may also include a vacuum relief valve 30.

The cyclone separator includes an input 37, in the embodiment shown in FIG. 9, there are two locations present for input, to allow for connection to the sanding machine, not shown. In the embodiment shown in FIG. 9, a knob 16, having a coupling nut 18 and gasket 14 is located at the superior surface of the cyclone separator 3 and also at the superior surface of the hopper 35.

In operation of the embodiment shown in FIG. 9, the air expelled from the cyclone separator 33 is then drawn through the duct work 31, pipe 44 and pipe elbow 42 to, where it is then expelled out of output 41 and optionally through the silencer 43. FIG. 9 also depicts a mounting bracket 38, for attaching the motor 17, displacement blower 13, and the cyclone separator 33 to base 40.

As will be apparent to those skilled in the art, the dimensional specifications of the present disclosure may vary to suit a variety of apparent embodiments. Generally, the vacuum in the present disclosure has a height of approximately 61 inches (155 cm), depth of approximately 28 inches (71 cm), height of approximately 62.5 inches (159 cm), weight of approximately 750 pounds (340 kg) and air volume of about 360 CFM MAX.

Although preferred embodiments of the disclosure are illustrated and described in connection with particular features, it can be adapted for use with a wide variety of floor and sanding machines. Other embodiments and equivalent floor sanding vacuums are envisioned within the scope of the claims. Various features of the disclosure have been particularly shown and described in connection with illustrated embodiments. However, it must be understood that the particular embodiments merely illustrate and that the invention is to be given its fullest interpretation within the terms of the claims.

What is claimed is:

1. A floor sanding vacuum for collecting dust from a floor sanding machine that generates dust, and discharging cleaned air, comprising:

a) an electric motor having a first drive shaft connected to a coupling, said coupling connected to a second drive shaft of a displacement blower;

b) said displacement blower, capable of drawing air to create a high vacuum, is connected to a cyclone separator by duct work;

c) said cyclone separator comprises an input for connection to floor sanding machine, a flexible hose is used for connecting the floor sanding machine to the cyclone separator, particulate matter being drawn through the flexible hose and through the input, an integral hopper for collection of debris;

d) said cyclone separator is connected to said duct work through which air is drawn and expelled through an output; and e) said cyclone separator, said motor and said displacement blower are attached to a base, wherein base comprises said integral hopper.

2. The floor sanding vacuum of claim 1, wherein said electric motor comprises an integral electronic control pad.

3. The floor sanding vacuum of claim 1, wherein said duct work further comprises a relief valve.

4. The floor sanding vacuum of claim 1, further comprising a replaceable filter element is a H.E.P.A. filter capable of removing 99.97 microns or larger.

5. The floor sanding vacuum of claim 1, wherein said output expels air to a silencer.

6. The floor sanding vacuum of claim 1, wherein said duct work is connected to said cyclone separator with a hose and clamp strap.

7. The floor sanding vacuum of claim 1, wherein said cyclone separator, said motor and said displacement blower are attached to said base by a mounting bracket.

8. A floor sanding vacuum for collecting dust from a floor sanding machine that generates dust and discharging cleaned air, comprising:

a) an gasoline motor including a pulley connected to a drive belt, said drive belt connected to a second pulley further connected to a displacement blower;

b) said displacement blower, capable of drawing air to create a high vacuum, is connected to a cyclone separator by duct work;

c) said cyclone separator includes an input for connection to floor sanding machine, flexible hose is used for connecting the floor sanding machine to the cyclone separator. particulate matter being drawn through the flexible hose and through the input, a replaceable filter element and an integral hopper for collection of debris;

d) said cyclone separator is connected to said duct work through which air is drawn and expelled through output; and e) said cyclone separator, said motor and said displacement blower are attached to a base, wherein base comprises said integral hopper.

9. The floor sanding vacuum of claim 8, wherein said pulley further comprises a first bushing and said second pulley further comprise a second bushing.

10. The floor sanding vacuum of claim 8, wherein said duct work further comprises a relief valve.

11. The floor sanding vacuum of claim 8, wherein said replaceable filter element is a H.E.P.A. filter capable of removing 99.97% of particulates 0.3 microns or larger.

12. The floor sanding vacuum of claim 8, wherein said output expels air to a silencer.

13. The floor sanding vacuum of claim 8, wherein said duct work is connected to said cyclone separator with a hose and clamp strap.

14. The floor sanding vacuum of claim 8, wherein said output comprises a pipe and pipe elbow.

15. The floor sanding vacuum of claim 8, wherein said cyclone separator, said motor and said displacement blower are attached to said base by a mounting bracket.

16. The floor sanding vacuum of claim 8, wherein a tensioner allows for appropriate tension in drive belt.

* * * * *